US011341904B2

(12) United States Patent
Yeh et al.

(10) Patent No.: US 11,341,904 B2
(45) Date of Patent: May 24, 2022

(54) LIGHT-EMITTING DIODE DRIVING APPARATUS AND LIGHT-EMITTING DIODE DRIVER

(71) Applicant: Novatek Microelectronics Corp., Hsinchu (TW)

(72) Inventors: Che-Wei Yeh, New Taipei (TW); Keko-Chun Liang, Hsinchu (TW); Yu-Hsiang Wang, Hsinchu (TW); Yong-Ren Fang, Kaohsiung (TW); Yi-Chuan Liu, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/138,772

(22) Filed: Dec. 30, 2020

(65) Prior Publication Data

US 2021/0118359 A1 Apr. 22, 2021

Related U.S. Application Data

(63) Continuation-in-part of application No. 16/841,686, filed on Apr. 7, 2020.

(Continued)

(30) Foreign Application Priority Data

Aug. 12, 2020 (TW) ..... 109127409

(51) Int. Cl.
*G09G 3/32* (2016.01)

(52) U.S. Cl.
CPC ..... *G09G 3/32* (2013.01); *G09G 2310/027* (2013.01)

(58) Field of Classification Search
CPC .. G09G 3/32; G09G 2310/027; G09G 3/2003; G09G 2340/16; G09G 2310/0275; G09G 2310/0286; G09G 2300/06
See application file for complete search history.

(56) References Cited

U.S. PATENT DOCUMENTS 10,565,935 B2 * 2/2020 Zeng ..... G09G 3/3266
2005/0135471 A1 * 6/2005 Tonietto ..... H03L 7/0807 375/233

(Continued)

FOREIGN PATENT DOCUMENTS

CN 1638367 7/2005
CN 1691655 11/2005

(Continued)

OTHER PUBLICATIONS

"Office Action of Taiwan Counterpart Application", dated Sep. 7, 2021, p. 1-p. 6.

*Primary Examiner* — Muhammad N Edun
(74) *Attorney, Agent, or Firm* — JCIPRNET

(57) ABSTRACT

A LED driving apparatus with clock embedded cascaded LED drivers is introduced, including: a plurality of LED drivers, wherein the first stage LED driver receives an original data signal and outputs a first data signal, the Nth stage LED driver receives a (N−1)th data signal and outputs a Nth data signal. The Nth stage LED driver includes a clock data recovery circuit generating a recovery clock signal and a recovery data signal according to the (N−1)th data signal; and a first transmitter outputting the Nth data signal according to the recovery clock signal and the recovery data signal.

24 Claims, 7 Drawing Sheets

Related U.S. Application Data

(60) Provisional application No. 62/885,830, filed on Aug. 13, 2019.

(56) References Cited

U.S. PATENT DOCUMENTS

| | | | | |
|---|---|---|---|---|
| 2007/0242007 | A1 | 10/2007 | Lee et al. | |
| 2011/0109228 | A1* | 5/2011 | Shimomura | H05B 45/37 315/113 |
| 2017/0084253 | A1* | 3/2017 | Li | G09G 5/393 |
| 2017/0124949 | A1* | 5/2017 | Lee | G09G 5/006 |
| 2021/0049952 | A1 | 2/2021 | Yeh et al. | |

FOREIGN PATENT DOCUMENTS

| | | |
|---|---|---|
| CN | 101365274 | 2/2009 |
| TW | 200741634 | 11/2007 |
| TW | M606401 | 1/2021 |

* cited by examiner

LIGHT-EMITTING DIODE DRIVING APPARATUS AND LIGHT-EMITTING DIODE DRIVER

CROSS-REFERENCE TO RELATED APPLICATION

This application is a continuation-in-part application of and claims the priority benefit of a prior application Ser. No. 16/841,686, filed on Apr. 7, 2020, which claims the priority benefit of U.S. provisional application Ser. No. 62/885,830, filed on Aug. 13, 2019, and claims the priority benefit of Taiwan Patent Application No. 109127409, filed on Aug. 12, 2020. The entirety of each of the above-mentioned patent applications is hereby incorporated by reference herein and made a part of this specification.

BACKGROUND

Technical Field

The invention relates to a light-emitting diode (LED) driver.

Description of Related Art

Generally, a cascaded LED driver transmission interface is used in a LED display system. In the cascaded LED driver transmission interface, besides data signal lines are used in any two adjacent LED drivers for the data transmission, a common clock signal line is also used and is coupled to each of the cascaded LED drivers. However, the common clock signal line may cause a large parasitic capacitance and limit the speed of the data transmission. In addition, the skew between the common clock signal and the data signal in each of the cascaded LED drivers may cause another issue and further limit the speed of the data transmission.

Nothing herein should be construed as an admission of knowledge in the prior art of any portion of the present disclosure.

SUMMARY

As demand for high resolution and better performance of the LED display system has grown recently, there has grown a need for a more creative technique to enhance the speed of the data transmission with the usage of clock embedded cascaded LED driver transmission interface.

A LED driving apparatus with clock embedded cascaded LED drivers that are capable of performing data transmission without the common clock signal line and therefore avoiding the limitation of the speed of the data transmission due to the large parasitic capacitance from the common clock signal line and the skew between the common clock signal and the data signal in each of the cascaded LED drivers is introduced.

In an embodiment of the disclosure, the LED driving apparatus includes a plurality of LED drivers, wherein the first stage LED driver receives an original data signal and outputs a first data signal, the Nth stage LED driver receives a (N−1)th data signal and outputs a Nth data signal, and N is a positive integer, wherein the Nth stage LED driver includes: a clock data recovery circuit, generating a recovery clock signal and a recovery data signal according to the (N−1)th data signal; and a first transmitter, outputting the Nth data signal according to the recovery clock signal and the recovery data signal.

In an embodiment of the disclosure, the LED driver includes a clock data recovery circuit, receiving a data signal to generate a recovery clock signal and a recovery data signal; a data storage, storing the recovery data signal; and a transmitter, outputting a next stage data signal according to the recovery clock signal and the recovery data signal.

To sum up, in the LED driving apparatus provided by the disclosure, the cost of chip package and complexity of printed circuit board routing is reduced by transmitting the data signal between each of the LED drivers without the common clock signal, and therefore the transmission speed of the data signal is enhanced.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Embodiments of the disclosure are described hereinafter with reference to the drawings.

Figure 1:
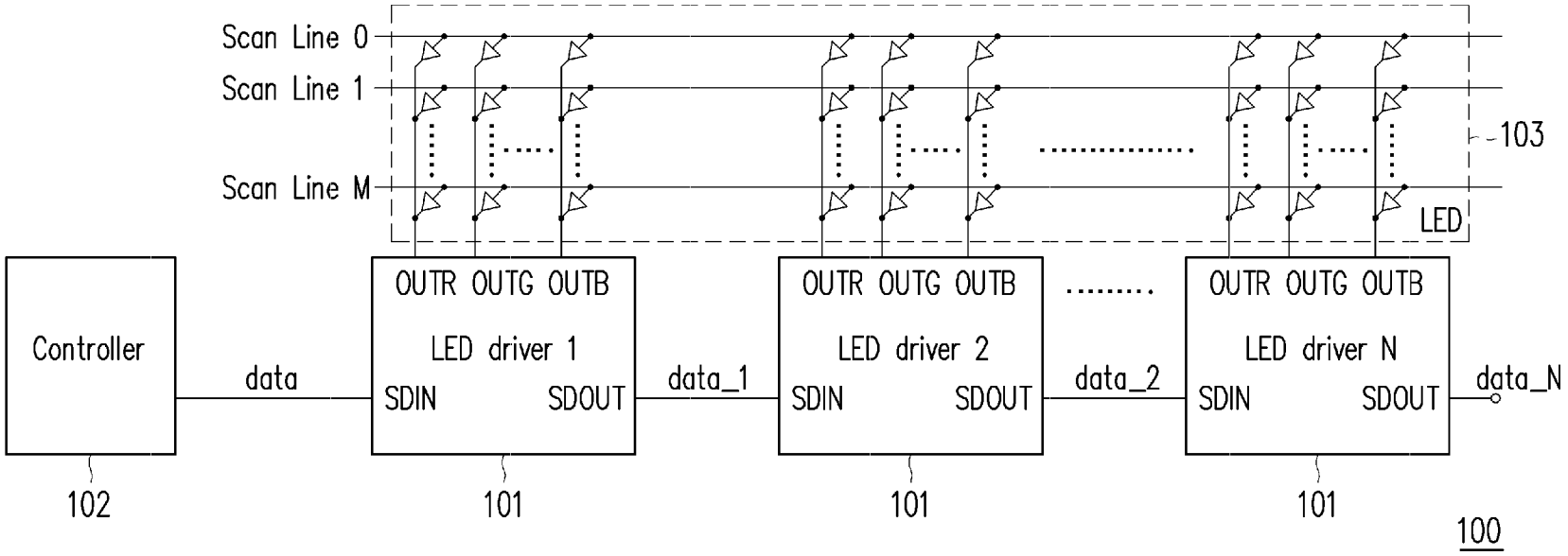
FIG. 1 is a schematic diagram of a light-emitting diode (LED) driving apparatus according to an embodiment of the disclosure.

FIG. 1 is a schematic diagram of a LED driving apparatus 100 according to an embodiment of the disclosure. The LED driving apparatus 100 includes a plurality of LED drivers 101, a controller 102, and a plurality of LEDs 103. The plurality of LED drivers 101 include cascaded N stages LED drivers from LED driver 1 to LED driver N, and N is a positive number. The controller 102 outputs an original data signal to the first stage LED driver 1, the first stage LED driver 1 receives the original data signal and outputs a first data signal data_1 to the second stage LED driver 2, and the (N−1)th stage LED driver (N−1) receives a (N−2)th data signal data_(N−2) and outputs the (N−1)th data signal data (N−1) to the Nth stage LED driver N.

Figure 2:
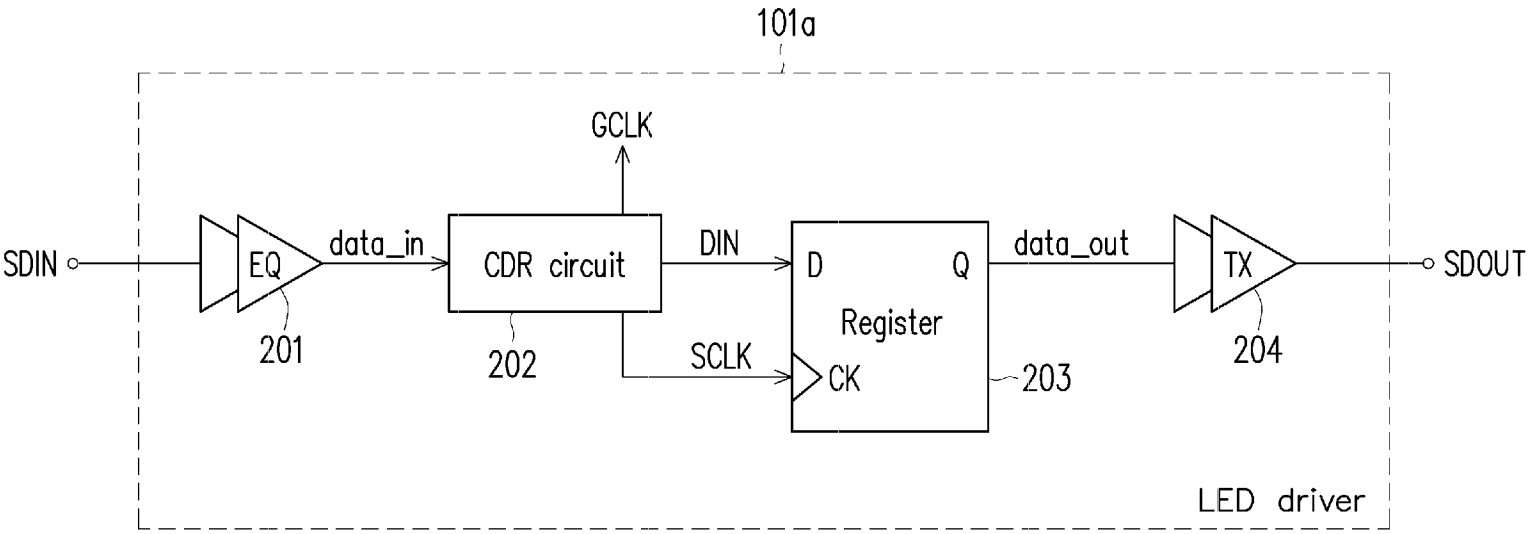
FIG. 2 is a schematic diagram of a LED driver in the LED driving apparatus according to an embodiment of the disclosure.

FIG. 2 is a schematic diagram of a LED driver 101*a* in the LED driving apparatus 100 according to an embodiment of the disclosure. As shown in FIG. 1 and FIG. 2, the Nth stage LED driver N includes an equalizer (EQ) 201, a clock data recovery (CDR) circuit 202, a first register 203 and a first transmitter 204. The EQ 201 in the LED driver N receives the (N−1)th data signal data_(N−1) and generates an equalized data signal data_in to the CDR circuit 202, the (N−1)th data signal data_(N−1) includes a previous stage display data signal encoded by a first encoding format and a previous stage clock signal encoded by the first encoding format. The CDR circuit 202 receives the equalized data signal data_in and generates a grayscale control clock signal GCLK, a recovery clock signal SCLK and a recovery data signal DIN according to a first phase difference between the equalized data signal data_in and the recovery clock signal SCLK. The grayscale control clock signal GCLK is used to control the grayscale of the LED display. The first register 203 may be a data storage storing the recovery data signal. The recovery clock signal SCLK and the recovery data signal DIN are inputted to the first register 203 to generate a first sampled recovery data signal data_out. The first transmitter 204 in the LED driver N receives the first sampled recovery data signal data_out and outputs the Nth data signal data_N including a next stage display data signal encoded by the first encoding format and a next stage clock signal encoded by the first encoding format according to the recovery clock signal SCLK and the recovery data signal DIN.

The plurality of LEDs 103 includes N stages LEDs from LED 1 to LED N corresponding to LED driver 1 to LED driver N respectively, and the Nth stage LED driver N drives the Nth stage LED N according to the gray scale control clock signal GCLK and the recovery data signal DIN in the LED driver N. The LED driver 1~the LED driver N may be an identical circuit structure.

As shown in FIG. 2, the first register 203 receives the recovery data signal DIN and the recovery clock signal SCLK to sample the recovery data signal DIN at clock signal edges of the recovery clock signal SCLK to generate the first sampled recovery data signal data_out according to the sampled values of the recovery data signal DIN and the clock signal edges of the recovery clock signal SCLK, and the first transmitter 204 in the LED driver N receives the first sampled recovery data signal data_out and outputs the Nth data signal data_N including the next stage display data signal encoded by the first encoding format and the next stage clock signal encoded by the first encoding format according to the first sampled recovery data signal data_out.

Figure 3:
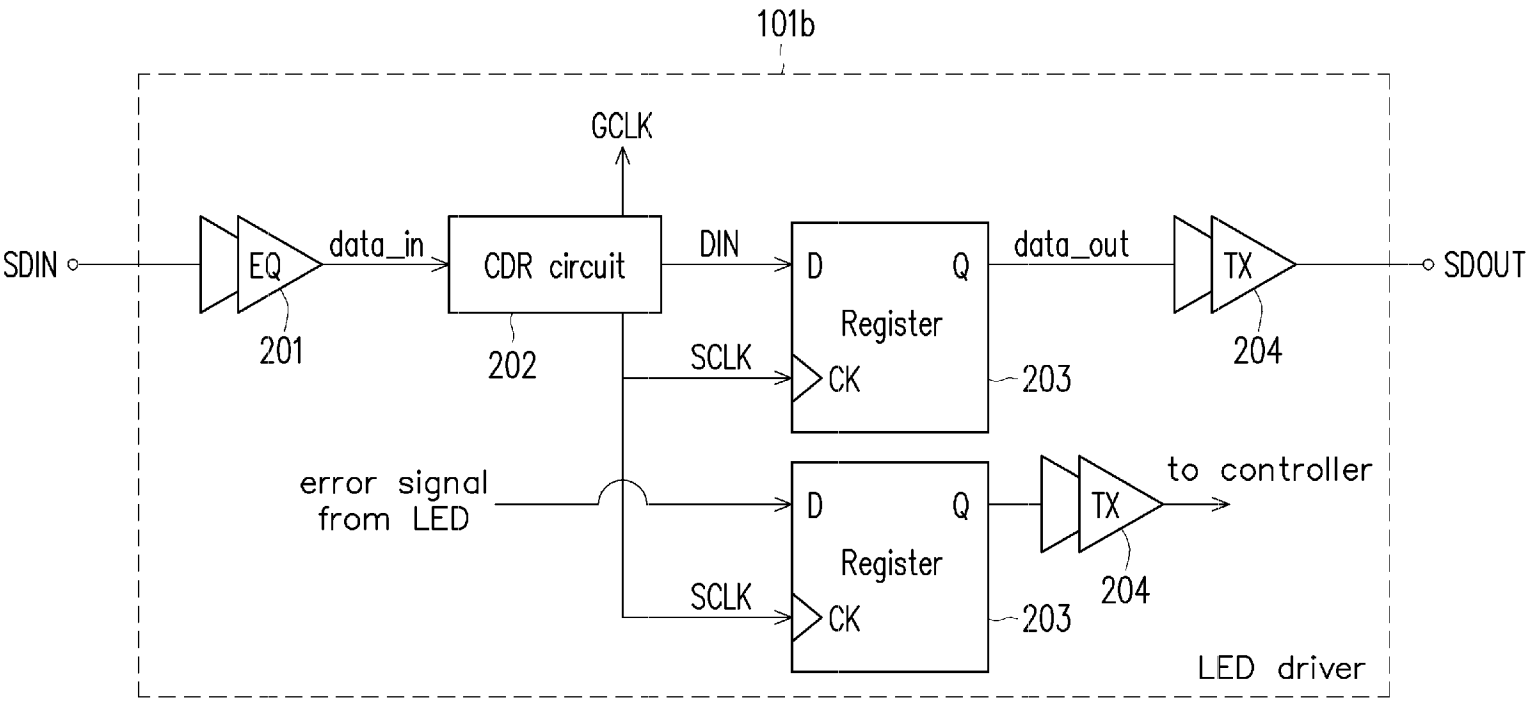
FIG. 3 is a schematic diagram of a LED driver in the LED driving apparatus according to another embodiment of the disclosure.

FIG. 3 is a schematic diagram of a LED driver 101*b* in the LED driving apparatus 100 according to another embodiment of the disclosure. Comparing to LED driver 101*a* of FIG. 2, the LED driver 101*b* further includes a second register 203 and a second transmitter 204. The second register 203 in the LED driver N receives an error signal from the Nth stage LED N and the recovery clock signal SCLK to sample the error signal at clock signal edges of the recovery clock signal SCLK to generate a sampled error signal according to the sampled values of the error signal and the clock signal edges of the recovery clock signal SCLK.

The second transmitter 204 in the LED driver N receives the sampled error signal and outputs an error readback signal to the controller 102 according to the sampled error signal, the error readback signal indicates a defect in the Nth stage LED N, and the first transmitter 204 and the second transmitter 204 may share one transmitter.

Figure 4:
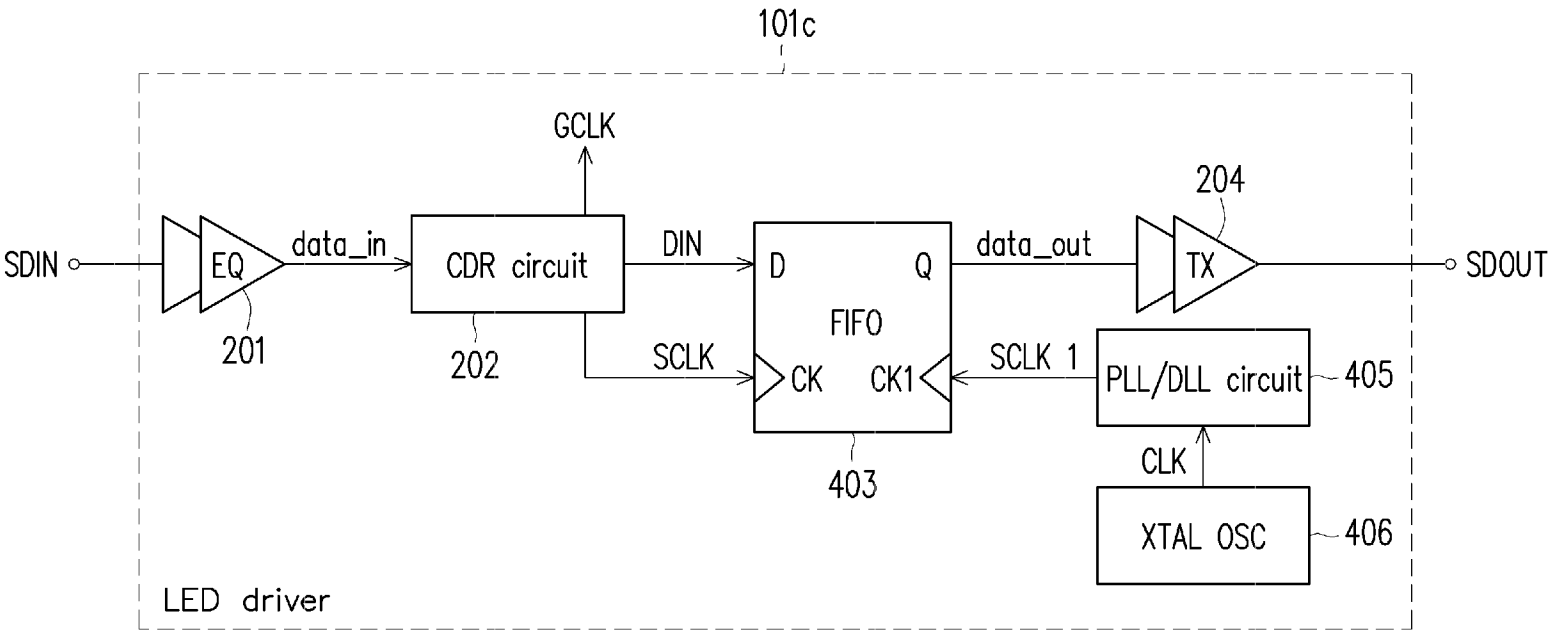
FIG. 4 is a schematic diagram of a LED driver in the LED driving apparatus according to another embodiment of the disclosure.

FIG. 4 is a schematic diagram of a LED driver 101*c* in the LED driving apparatus 100 according to another embodiment of the disclosure. Comparing to LED driver 101*a* of FIG. 2, the LED driver 101*c* further includes a phase-locked loop (PLL) or a delay-locked loop (DLL) circuit 405 and a crystal oscillator (XTAL OSC) 406, and the first register 203 in the LED driver 101*a* is replaced with a first in first out (FIFO) circuit 403 in the LED driver 101*c*.

The FIFO circuit 403 may be a data storage storing the recovery data signal. The FIFO circuit 403 receives the recovery data signal DIN, the recovery clock signal SCLK and a FIFO readout clock signal SCLK1 to sample the recovery data signal DIN at clock signal edges of the recovery clock signal SCLK to generate a second sampled recovery data signal data_out according to the sampled values of the recovery data signal DIN and clock signal edges of the FIFO readout clock signal SCLK1.

Figure 6A:
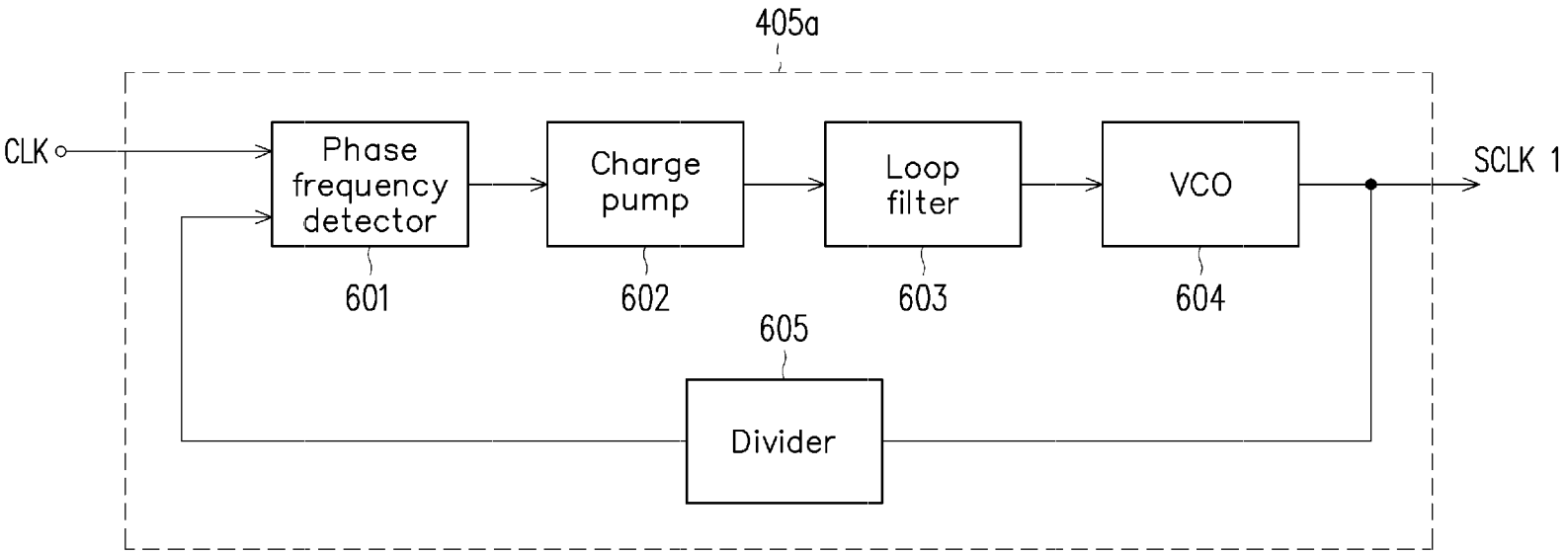
FIG. 6A to 6B are schematic diagrams of a phase-locked loop circuit and a delay-locked loop circuit in the LED driving apparatus according to an embodiment of the disclosure.
Figure 6B:
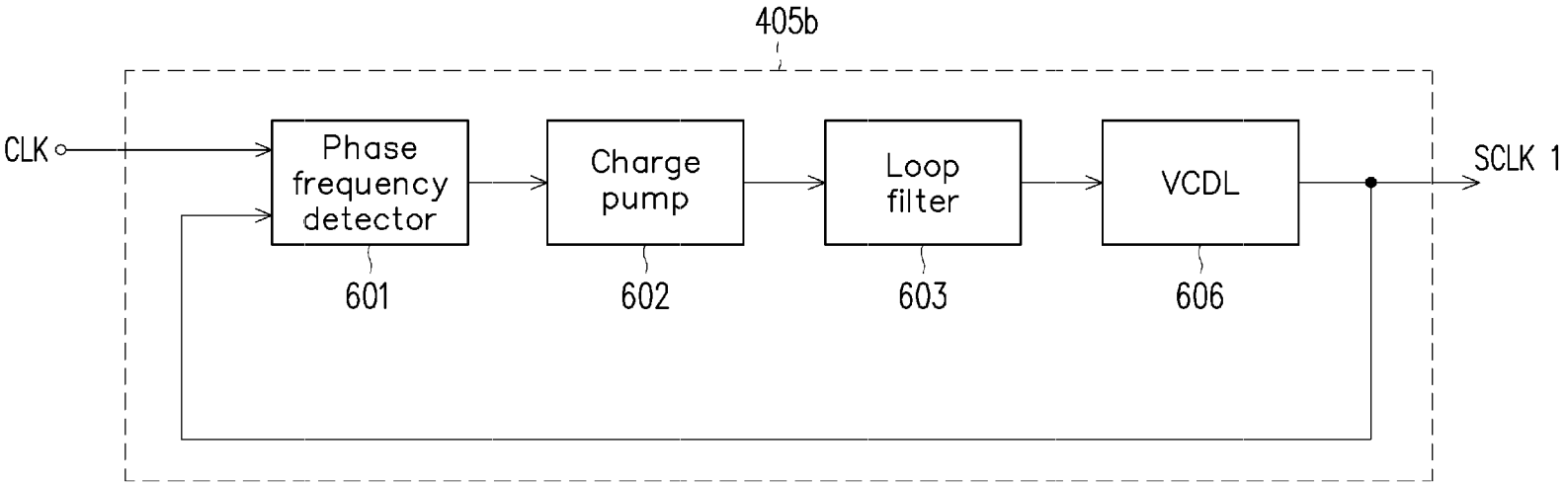

FIG. 6A to 6B are schematic diagrams of a PLL circuit 405*a* and a DLL circuit 405*b* in the LED driving apparatus 100 according to an embodiment of the disclosure. The FIFO readout clock signal SCLK1 is generated by the PLL circuit 405*a* or the DLL circuit 405*b*. The XTAL OSC 406 generates an input clock signal CLK to the PLL circuit 405*a*, and the PLL circuit 405*a* receives the input clock signal CLK to generate the FIFO readout clock signal SCLK1 according to a second phase difference between the input clock signal CLK and the FIFO readout clock signal SCLK1, and the PLL 405*a* circuit includes a frequency divider.

In another embodiment of the disclosure, the XTAL OSC 406 generates the input clock signal CLK to the DLL circuit 405*b*, and the DLL circuit 405*b* receives the input clock signal CLK to generate the FIFO readout clock signal SCLK1 according to a third phase difference between the input clock signal CLK and the FIFO readout clock signal SCLK1.

Figure 5:
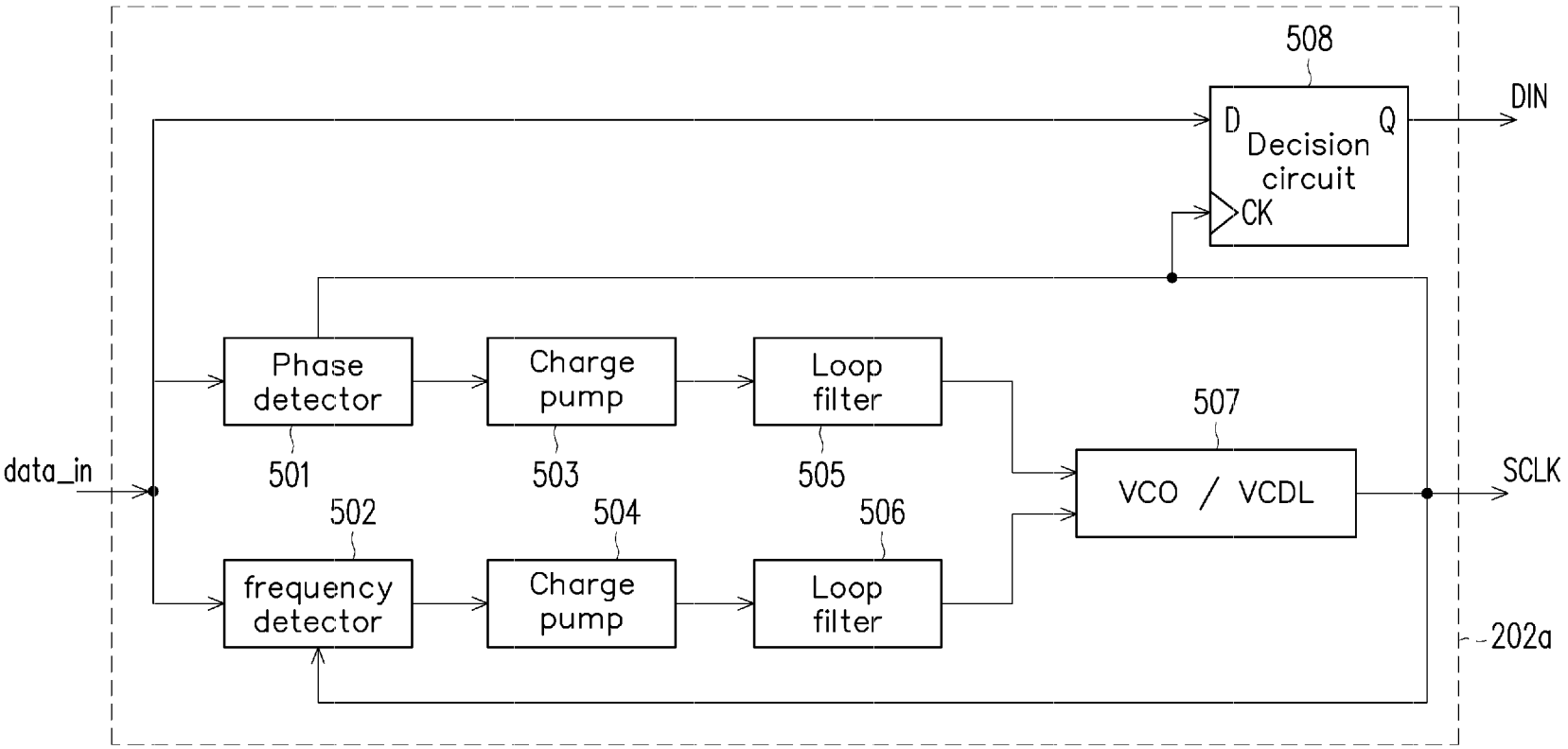
FIG. 5 is a schematic diagram of a clock data recovery circuit in the LED driving apparatus according to an embodiment of the disclosure.

FIG. 5 is a schematic diagram of a CDR circuit 202*a* in the LED driving apparatus 100 according to an embodiment of the disclosure. The CDR circuit 202*a* in the LED driver N includes a phase detector 501, receiving the (N−1)th data signal data_(N−1) and the recovery clock signal SCLK to generate a phase detecting signal according to the first phase difference between the (N−1)th data signal data_(N−1) and the recovery clock signal SCLK; a frequency detector 502, receiving the (N−1)th data signal data_(N−1) and the recovery clock signal SCLK to generate a frequency detecting signal according to a frequency difference between the (N−1)th data signal data_(N−1) and the recovery clock signal SCLK; a voltage-controlled oscillator (VCO) 507 or a voltage-controlled delay line (VCDL) 507, generating the recovery clock signal SCLK according to the phase detecting signal and the frequency detecting signal; and a decision circuit 508, receiving the (N−1)th data signal data_(N−1) and the recovery clock signal SCLK to generate the recovery data signal DIN according to the (N−1)th data signal data_(N−1) and the recovery clock signal SCLK.

As the LED driver 101*a*~LED driver 101*c* shown in FIG. 2~FIG. 4 respectively, the CDR circuit 202 in the LED driver N further generates a gray scale control clock signal GCLK to control a gray scale of the Nth stage LED N according to the recovery clock signal SCLK.

From the above embodiments, the LED driving apparatus 100 with the clock embedded cascaded LED drivers that are capable of performing data transmission without the common clock signal line and therefore avoiding the limitation of the speed of the data transmission due to the large parasitic capacitance from the common clock signal line and the skew between the common clock signal and the data signal in each of the cascaded LED drivers is introduced. With the LED driving apparatus 100, the cost of chip package and complexity of printed circuit board routing is reduced by transmitting the data signal between each of the LED drivers without the common clock signal, and therefore the transmission speed of the data signal is enhanced.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A Light-emitting diode (LED) driving apparatus, comprising:

a plurality of LED drivers, wherein the first stage LED driver receives an original data signal and outputs a first data signal, the Nth stage LED driver receives a (N−1) th data signal and outputs a Nth data signal, and N is a positive integer, wherein the Nth stage LED driver comprises:

a clock data recovery circuit, generating a recovery clock signal and a recovery data signal according to the (N−1)th data signal;

a data storage, sampling the recovery data signal at clock signal edges of the recovery clock signal to generate a sampled recovery data signal; and a first transmitter, outputting the Nth data signal according to the sampled recovery data signal.

2. The LED driving apparatus as claimed in claim 1, wherein the Nth stage LED driver comprises:

an equalizer, receiving the (N−1)th data signal and generating an equalized data signal to the clock data recovery circuit; and a first register, receiving the recovery data signal and the recovery clock signal to sample the recovery data signal at clock signal edges of the recovery clock signal to generate a first sampled recovery data signal according to the sampled values of the recovery data signal and the clock signal edges of the recovery clock signal, wherein the first transmitter receives the first sampled recovery data signal and outputting the Nth data signal according to the first sampled recovery data signal.

3. The LED driving apparatus as claimed in claim 2, wherein the Nth stage LED driver comprises:

a second register, receiving an error signal and the recovery clock signal to sample the error signal at clock signal edges of the recovery clock signal to generate a sampled error signal according to the sampled values of the error signal and the clock signal edges of the recovery clock signal, wherein the error signal is from a Nth stage LED; and a second transmitter, receiving the sampled error signal and outputting an error readback signal to a controller according to the sampled error signal, wherein the error readback signal indicates a defect in the Nth stage LED.

4. The LED driving apparatus as claimed in claim 1, wherein the Nth stage LED driver comprises:

an equalizer, receiving the (N−1)th data signal and generating an equalized data signal to the clock data recovery circuit;

a first in first out (FIFO) circuit, receiving the recovery data signal, the recovery clock signal and a FIFO readout clock signal to sample the recovery data signal at clock signal edges of the recovery clock signal to generate a second sampled recovery data signal according to the sampled values of the recovery data signal and clock signal edges of the FIFO readout clock signal; and a reference clock generator, generating the FIFO readout clock signal, wherein the first transmitter receives the second sampled recovery data signal and outputting the Nth data signal according to the second sampled recovery data signal.

5. The LED driving apparatus as claimed in claim 4, wherein the reference clock generator comprises:

a crystal oscillator, generating an input clock signal; and a phase-locked loop circuit, receiving the input clock signal to generate the FIFO readout clock signal according to a second phase difference between the input clock signal and the FIFO readout clock signal, wherein the phase-locked loop circuit comprises a frequency divider.

6. The LED driving apparatus as claimed in claim 4, wherein the reference clock generator comprises:

a crystal oscillator, generating an input clock signal; and a delay-locked loop circuit, receiving the input clock signal to generate the FIFO readout clock signal according to a third phase difference between the input clock signal and the FIFO readout clock signal.

7. The LED driving apparatus as claimed in claim 1, wherein the clock data recovery circuit comprises:

a phase detector, receiving the (N−1)th data signal and the recovery clock signal to generate a phase detecting signal according to a first phase difference between the (N−1)th data signal and the recovery clock signal;

a frequency detector, receiving the (N−1)th data signal and the recovery clock signal to generate a frequency detecting signal according to a frequency difference between the (N−1)th data signal and the recovery clock signal;

a voltage-controlled oscillator, generating the recovery clock signal according to the phase detecting signal and the frequency detecting signal; and a decision circuit, receiving the (N−1)th data signal and the recovery clock signal to generate the recovery data signal according to the (N−1)th data signal and the recovery clock signal.

8. The LED driving apparatus as claimed in claim 1, wherein the clock data recovery circuit further generates a gray scale control clock signal to control a gray scale of the Nth stage LED according to the recovery clock signal.

9. The LED driving apparatus as claimed in claim 1, wherein the (N−1)th data signal received by the Nth stage LED driver comprises a (N−1)th display data signal and a (N−1)th clock signal, and the (N−1)th display data signal and the (N−1)th clock signal are encoded with a first encoding format.

10. The LED driving apparatus as claimed in claim 9, wherein the Nth data signal outputted by the Nth stage LED driver comprises a Nth display data signal and a Nth clock signal, and the Nth display data signal and the Nth clock signal are encoded with the first encoding format.

11. A Light-emitting diode (LED) driver, comprising:

a clock data recovery circuit, receiving a data signal to generate a recovery clock signal and a recovery data signal;

a data storage, sampling the recovery data signal at clock signal edges of the recovery clock signal to generate a sampled recovery data signal; and a transmitter, outputting a next stage data signal according to the sampled recovery data signal.

12. The LED driver as claimed in claim 11, wherein the data storage is a register.

13. The LED driver as claimed in claim 12, wherein the register receives the recovery data signal and the recovery clock signal to sample the recovery data signal at clock signal edges of the recovery clock signal to generate a first sampled recovery data signal according to the sampled values of the recovery data signal and the clock signal edges of the recovery clock signal, wherein the transmitter receives the first sampled recovery data signal and outputs the next stage data signal according to the first sampled recovery data signal.

14. The LED driver as claimed in claim 13, wherein the register receives an error signal and the recovery clock signal to sample the error signal at clock signal edges of the recovery clock signal to generate a sampled error signal according to the sampled values of the error signal and the clock signal edges of the recovery clock signal, wherein the error signal is from a LED corresponding to the LED driver.

15. The LED driver as claimed in claim 14, wherein the transmitter receives the sampled error signal and outputs an error readback signal to a controller according to the sampled error signal, wherein the error readback signal indicates a defect in the LED.

16. The LED driver as claimed in claim 11, wherein the data storage is a first in first out (FIFO) circuit.

17. The LED driver as claimed in claim 16, wherein the FIFO circuit receives the recovery data signal, the recovery clock signal and a FIFO readout clock signal to sample the recovery data signal at clock signal edges of the recovery clock signal to generate a second sampled recovery data signal according to the sampled values of the recovery data signal and clock signal edges of the FIFO readout clock signal.

18. The LED driver as claimed in claim 17, wherein the FIFO readout clock signal is generated by a reference clock generator, and the transmitter receives the second sampled recovery data signal and outputs the next stage data signal according to the second sampled recovery data signal.

19. The LED driver as claimed in claim 18, wherein the reference clock generator comprises:

a crystal oscillator, generating an input clock signal; and a phase-locked loop circuit, receiving the input clock signal to generate the FIFO readout clock signal according to a first phase difference between the input clock signal and the FIFO readout clock signal, wherein the phase-locked loop circuit comprises a frequency divider.

20. The LED driver as claimed in claim 18, wherein the reference clock generator comprises:

a crystal oscillator, generating an input clock signal; and a delay-locked loop circuit, receiving the input clock signal to generate the FIFO readout clock signal according to a second phase difference between the input clock signal and the FIFO readout clock signal.

21. The LED driver as claimed in claim 11, wherein the clock data recovery circuit comprises:

a phase detector, receiving a previous stage data signal and the recovery clock signal to generate a phase detecting signal according to a third phase difference between the previous stage data signal and the recovery clock signal;

a frequency detector, receiving the previous stage data signal and the recovery clock signal to generate a frequency detecting signal according to a frequency difference between the previous stage data signal and the recovery clock signal;

a voltage-controlled oscillator, generating the recovery clock signal according to the phase detecting signal and the frequency detecting signal; and a decision circuit, receiving the previous stage data signal and the recovery clock signal to generate the recovery data signal according to the previous stage data signal and the recovery clock signal.

22. The LED driver as claimed in claim 11, wherein the clock data recovery circuit further generates a gray scale control clock signal to control a gray scale of a LED corresponding to the LED driver according to the recovery clock signal.

23. The LED driver as claimed in claim 11, wherein the data signal received by the LED driver comprises a display data signal and a clock signal, and the display data signal and the clock signal are encoded with a first encoding format.

24. The LED driver as claimed in claim 23, wherein the next stage data signal outputted by the LED driver comprises a next stage display data signal and a next stage clock signal, and the next stage display data signal and the next stage clock signal are encoded with the first encoding format.

* * * * *